US005170174A

United States Patent [19]

Caer et al.

[11] Patent Number: 5,170,174

[45] Date of Patent: Dec. 8, 1992

[54] PATCH-EXCITED NON-INCLINED RADIATING SLOT WAVEGUIDE

[75] Inventors: Daniel Caer, Chatillon; Jean Le Foll, Montlhery; Joseph Roger, Bures S/Yvette, all of France

[73] Assignee: Thomson-CSF, Puteaux, France

[21] Appl. No.: 603,455

[22] Filed: Oct. 25, 1990

[30] Foreign Application Priority Data

Nov. 14, 1989 [FR] France ..... 89 14896

[51] Int. Cl.[5] ..... H01Q 13/10

[52] U.S. Cl. ..... 343/771

[58] Field of Search ..... 343/767, 768, 770, 771, 343/778

[56] References Cited

U.S. PATENT DOCUMENTS

| | | | |
|---|---|---|---|
| 2,574,433 | 11/1951 | Clapp | 343/771 |
| 3,176,300 | 3/1965 | Knecken | 343/771 |
| 3,806,945 | 4/1974 | Proctor | 343/725 |
| 3,827,054 | 7/1974 | Herskind | 343/768 |
| 4,303,923 | 12/1981 | Bitter et al. | 343/771 |
| 4,360,813 | 11/1982 | Fitzsimmons | 343/770 |
| 4,435,715 | 3/1984 | Ajiora | 343/771 |

OTHER PUBLICATIONS

Watts, "Simultaneous Radiation of Odd and Even Patterns by a Linear Array", IRE proceedings, Oct. 1952, pp. 1236-1239.

*Primary Examiner*—Michael C. Wimer
*Attorney, Agent, or Firm*—Roland Plottel

[57] ABSTRACT

In a waveguide (1) having slots (2, 3) perpendicular to the axis of the waveguide and cut in a narrow wall of the waveguide, a printed circuit plate (4) is positioned. This plate has patches (5, 7) for coupling with the energy being propagated in the waveguide and microstrip lines (6, 8) connected to the patches to excite the slots (2, 3) with the energy thus tapped. These slot waveguides can be used particularly in array antennas.

7 Claims, 2 Drawing Sheets

PATCH-EXCITED NON-INCLINED RADIATING SLOT WAVEGUIDE

BACKGROUND OF THE INVENTION

1. Field of the Invention

The present invention pertains to a patch-excited non-inclined radiating slot waveguide, of the type having slots perpendicular to the axis of the guide, cut out on a narrow wall of the guide with a spacing substantially equal to a half wavelength of operation in the guide.

2. Description of the Prior Art

Slot waveguides are frequently used as linear arrays of radiating sources in antenna arrays, for example in radar. They have the advantages of low cost and low losses. T obtain radiation close to the perpendicular to the waveguide, and good matching, there should be, firstly, a distance between successive slots that is close to $\lambda g/2$, where $\lambda g$ is the wavelength in the waveguide and, secondly, a supplementary phase shift of $\pi$ between two consecutive slots.

These conditions can be met with slots positioned in the broad wall of a rectangular-section waveguide or on the narrow wall. The fact that the slots are positioned in the broad wall has many drawbacks, notably a big pitch between successive waveguides. This restricts the scanning angle of the beam in a plane perpendicular to the waveguides. It is preferred, therefore, to use slots on the narrow wall of the waveguides.

If the slots are perpendicular to the axis of the waveguide, there is no energy coupling between the slots and the waveguide, and the radiation is zero.

In a first approach to this problem, therefore, the slots are inclined alternately on either side to obtain the above-stated necessary conditions. However, owing to the inclination of the slots, this approach has the drawback of radiating a cross-polarized component which ma attain levels incompatible with the efficient operation of the antenna using these waveguides.

Another known approach, then, consists in using slots that are not inclined (i.e. that are perpendicular to the axis of the waveguide) and in exciting them by means of an obstacle (for example, irises or rods) placed in the waveguide.

In particular, the U.S. Pat. No. 4,435,715 (Hughes Aircraft) describes a waveguide with non-inclined slots in which the excitation of a slot is obtained by placing conductive rods on either side of the slot. Each slot is positioned between an edge of the slot and one of the broad walls of the waveguide. However, an approach such as this has the drawback of being costly to implement. Indeed, the rods have to be fixed individually within the waveguide, for example by dip soldering.

SUMMARY OF THE INVENTION

An object of the invention is a slotted waveguide that overcomes these drawbacks by the use of flat radiating conductive patches t excite each slot.

According to the invention, there is provided a waveguide with patch-excited non-inclined radiating slots of the type including slots perpendicular to the axis of the waveguide cut out on a narrow wall of the waveguide with a spacing that is substantially equal to a half wavelength of operation in the waveguide, wherein each slot is excited by means of a patch positioned in the waveguide in the vicinity of the slot, in parallel with said narrow wall and acting as a coupling antenna with the energy being propagated in the waveguide, said patch transmitting the energy picked up at said associated slot by means of a transmission line connected to said patch.

BRIEF DESCRIPTION OF THE DRAWINGS

The invention will be understood more clearly and other characteristics and advantages will appear from the following description and from the appended drawings, wherein.

DESCRIPTION OF THE PREFERRED EMBODIMENTS

In all the figures, the same reference numbers are repeated for the same elements.

Figure 1:
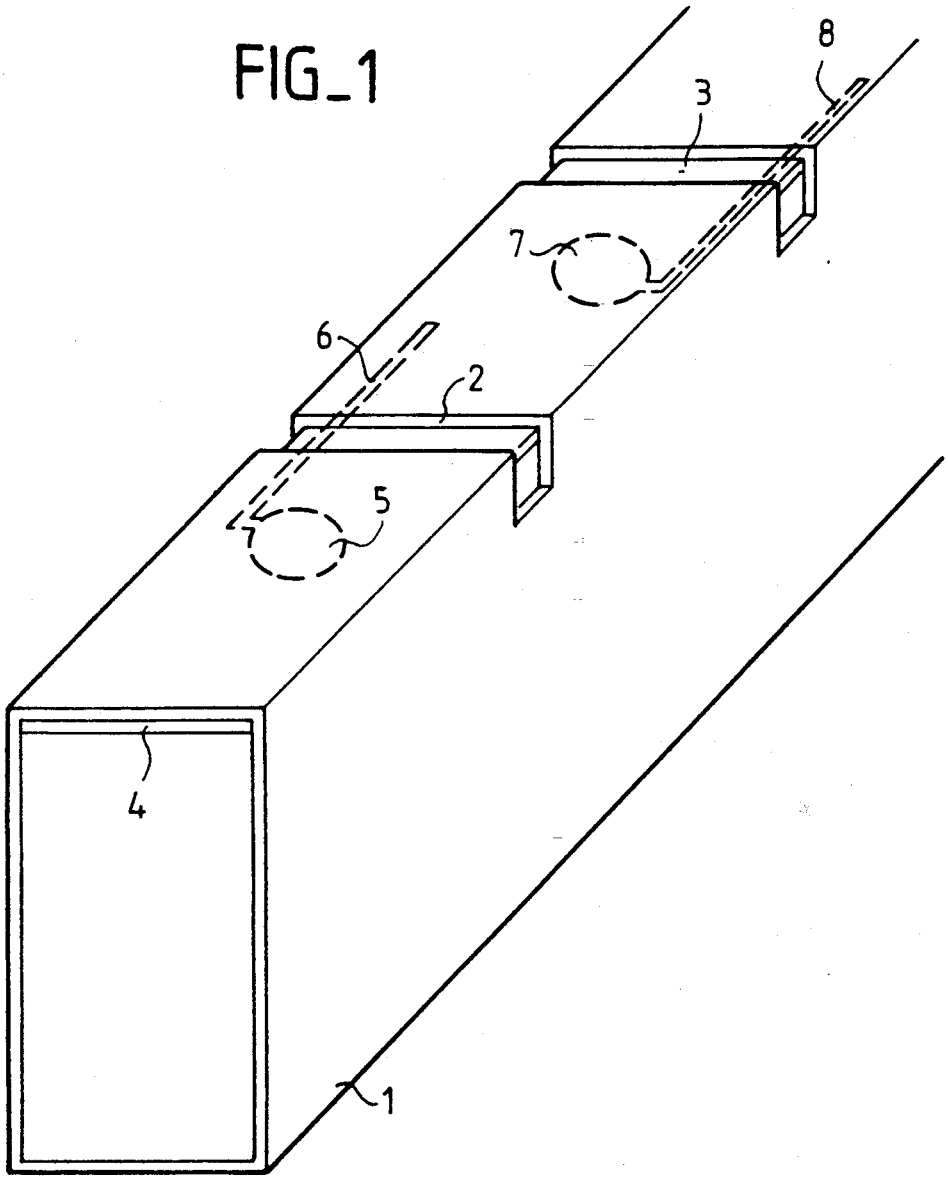
FIG. 1 shows a view in perspective of a slotted waveguide according to the invention.
Figure 2:
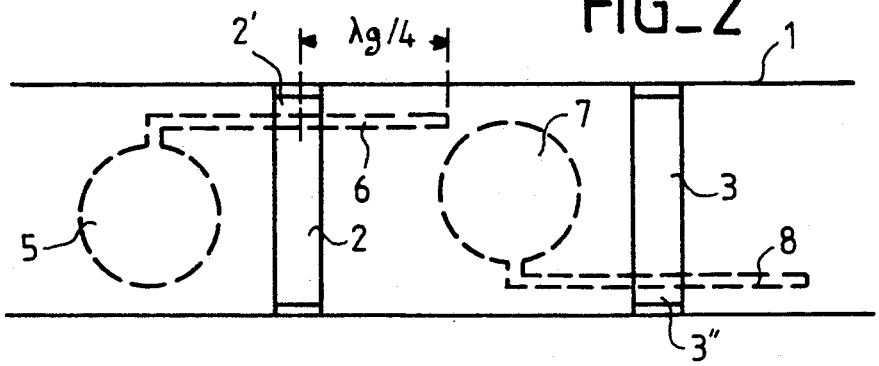
FIG. 2 shows a front view of the waveguide of FIG. 1, on the radiating slots side.

FIGS. 1 and 2 show a waveguide 1 having radiating slots 2, 3 cut out in the narrow wall. These slots are not inclined, i.e. they are perpendicular to the axis of the waveguide. As already mentioned, such slots are normally not coupled to the energy being propagated in the waveguide 1, and therefore do not radiate.

According to the invention, there is provision for patches 5, 7 on a dielectric plate 4 which is fixed against the narrow wall having the slots. These patches serve as antennas, each associated with a microstrip type transmission line 6, 8 cutting the associated slots transversally. The patch/microstrip line sets recur at the same pitch as the slots, i.e. substantially at $\lambda g/2$ where $\lambda g$ is the waveguide 1 operating wavelength.

The patches 5, 7 serve as coupling antennas with the electromagnetic energy being propagated in the waveguide 1. The energy picked up by a patch 5, 7 feeds the line 6, 8 that is connected to it, and this line excites the associated slot 2, 3 which then radiates the energy that is thus transmitted to it.

The patches 5, 7 and the lines 6, 8 are made employing printed circuit techniques on that face of the plate 4 which is not in contact with the narrow wall bearing the slots. This narrow wall acts as a ground plane for the patches 5, 7 and for the microstrip lines 6, 8. The plate 4 is fixed against the narrow wall for example by bonding.

As can be seen more clearly in FIG. 2, the patches are not placed facing the slots. This is so that they do not disturb the behavior of these slots and the radiation that they give. Furthermore, the microstrip lines 6, 8 are extended by a length substantially equal to $\lambda g/4$ beyond the associated slot. This corresponds substantially to a short-circuit at the slot.

As already indicated further above, the slots are spaced out substantially at a distance of $\lambda g/2$, and an additional phase shift of $\pi$ has to be provided between two consecutive slots. This phase shift is obtained by tapping energy alternately on either side of the corresponding patch and, consequently, by exciting the slots 2, 3 alternately at one end 2' and at the other end 3'' (FIG. 2). The slot following the slot 3 will thus be excited at its end located on its end 2' side.

The figures show circular patches, but any other geometrical shape, such as that of a square, rectangle or triangle, could have been opted for.

The value of the coupling of the patch with the wave propagated in the waveguide ma be set by the diameter of the patch (or its dimensions in the case of shapes other than circular ones).

Another way to set the coupling coefficient of the slot is to modify the position of the point of connection of the microstrip line with the patch. Indeed, the coupling is theoretically zero for a point located in the median plane of the waveguide and increases up to a maximum when the connection point moves away towards the points located in the median plane of the patch parallel to the slots, i.e. when it moves away towards the broad walls of the waveguide.

Figure 3:
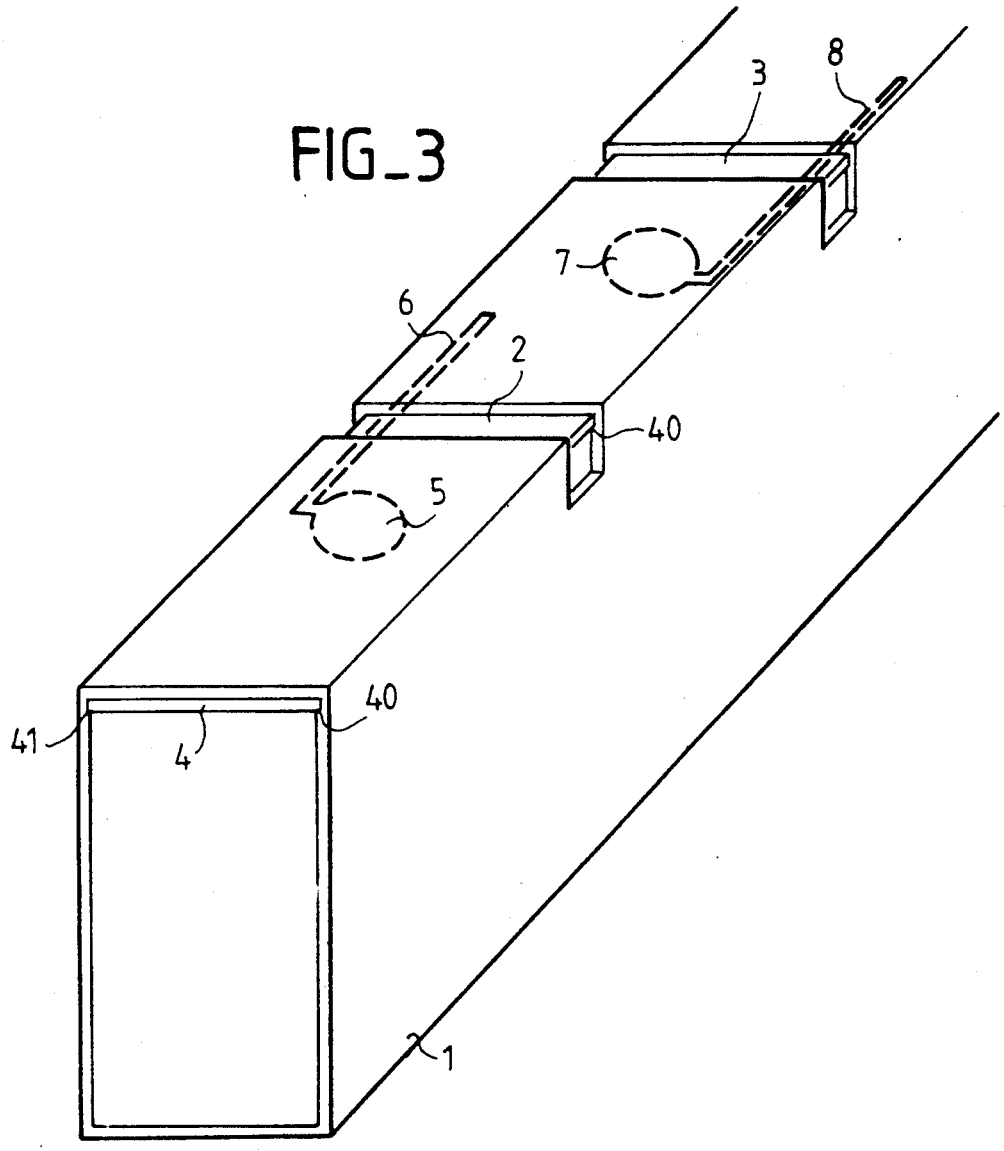
FIGS. 3 and 4 show alternative embodiments of the slotted waveguide according to the invention.

FIG. 3 shows a variant in which the plate 4 is held in position by being given a width slightly greater than the internal width of the narrow wall bearing the slots. There is provision, furthermore, for two grooves 40, 41 in the broad walls of the waveguide 1, adjacent to the narrow wall bearing the slots. The plate 4 is then slid into the grooves 40, 41 where it is thus held in position. A fastening and any stop element enable the patch/line sets to be centered accurately on the associated slots.

Figure 4:
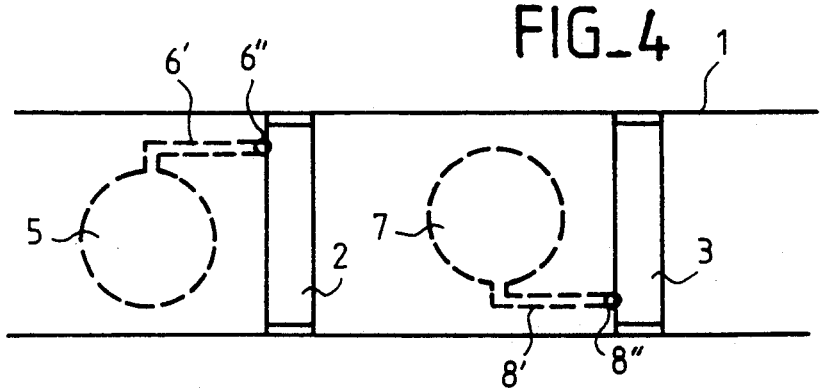

FIG. 4, which is similar to FIG. 2, shows another alternative embodiment in which the microstrip line 6', 8' is electrically connected to a longitudinal edge of the slot 2, 3. This may be achieved, for example, by means of a metallized hole 6'', 8'' through the dielectric plate. In this case, the microstrip line does not need to extend beyond the metallized hole.

It is clear that the exemplary embodiments described in no way restrict the scope of the invention.

What is claimed is:

1. A slot waveguide having a rectangular section with a narrow wall, a broad wall and a longitudinal axis, and comprising:

a plurality of slots cut out on said narrow wall perpendicularly to said axis, and spaced out among one another substantially by a half wavelength of operation in the waveguide;

a plurality of patches positioned in said waveguide, each one of said patches being associated with a respective slot and located at such a given distance from said associated slot that said slots do not face said patches, each patch being arranged in parallel to said narrow wall and serving as a coupling element for the coupling with the energy being propagated in the waveguide so as to excite said associated slot; and a plurality of microstrip lines parallel to said narrow wall and each connected to a respective one of said patches, each of said microstrip lines extending from said respective patch across the associated slot and beyond said associated slot by a length substantially equal to a quarter wavelength of operation.

2. A slot waveguide having a rectangular section with a narrow wall, a broad wall and a longitudinal axis, and comprising:

a plurality of slots cut out on said narrow wall perpendicularly to said axis, and spaced out among one another substantially by a half wavelength of operation in the waveguide;

a plurality of patches positioned in said waveguide, each one of said patches being associated with a respective slot and located at such a given distance from said associated slot that said slots do not face said patches, each patch being arranged in parallel to said narrow wall and serving as a coupling element for the coupling with the energy being propagated in the waveguide so as to excite said associated slot; and a plurality of microstrip lines parallel to said narrow wall and each connected to a respective one of said patches, each of said microstrip lines extending from said respective patch to the associated slot and being connected to one edge of said associated slot perpendicular to said axis.

3. A slot waveguide according to any of the claims 1 or 2, wherein said patches and said microstrip lines are made by printed circuit techniques on one face of a plate made of dielectric material with a spacing equal to that of the slots of the waveguide and wherein said plate is fixed with its other face against the internal wall of the narrow wall of said waveguide bearing the slots, said narrow wall serving as a ground plane for said microstrip lines.

4. A slot waveguide according to any one of claims 1 or 2, wherein the point of connection of each line with the associated patch is located on the periphery of said patch substantially in a median plane of the patch parallel to the slots.

5. A slot waveguide according to claim 4, wherein said lines are connected to the corresponding patches alternately in consecutive patches, on one side and on the opposite side of said patches in said median planes so as to introduce an additional phase shift of $\pi$ between the excitations of two consecutive slots.

6. A slot waveguide according to claim 5, wherein said lines excite the associated slots alternately at one end and at the other of the slots, corresponding to the side of said patches where said associated lines are connected.

7. A slot waveguide according to claim 3, wherein the width of said plate has a value between the internal width and the external width of the narrow wall of the waveguide bearing the slots and wherein each of the broad walls of the waveguide includes a groove adjacent to said narrow wall bearing the slots, to make said plate slide into said grooves and hold said plate in position.

* * * * *